US008715098B2

(12) United States Patent
Napolitano et al.

(10) Patent No.: US 8,715,098 B2
(45) Date of Patent: May 6, 2014

(54) GOLF SWING TRAINING DEVICE

(76) Inventors: David Napolitano, Punta Gorda, FL (US); Don Drum, Port Charlotte, FL (US)

( * ) Notice: Subject to any disclaimer, the term of this patent is extended or adjusted under 35 U.S.C. 154(b) by 401 days.

(21) Appl. No.: 13/232,288

(22) Filed: Sep. 14, 2011

(65) Prior Publication Data

US 2013/0065704 A1 Mar. 14, 2013

(51) Int. Cl.
*A63B 69/38* (2006.01)

(52) U.S. Cl.
USPC ..... 473/257; 473/258; 473/259

(58) Field of Classification Search
USPC ..... 473/257, 258, 259
See application file for complete search history.

(56) References Cited

U.S. PATENT DOCUMENTS

| | | | | | |
|---|---|---|---|---|---|
| 1,567,530 | A | * | 12/1925 | MacNaughton et al. | 473/229 |
| 1,944,942 | A | | 1/1934 | MacDonald | |
| 1,960,787 | A | | 5/1934 | MacStocker | |
| 3,341,208 | A | | 9/1967 | Marcella | |
| 3,711,103 | A | | 1/1973 | Seltzer | |
| 4,280,701 | A | | 7/1981 | Beckish | |
| 4,583,740 | A | * | 4/1986 | Ohly | 473/259 |
| 4,852,881 | A | | 8/1989 | Bellagamba et al. | |
| 5,072,942 | A | * | 12/1991 | Hurley | 473/229 |
| 5,255,921 | A | | 10/1993 | Spence | |
| 5,330,192 | A | | 7/1994 | Amos | |
| 5,423,548 | A | | 6/1995 | Bricker | |
| 5,439,225 | A | * | 8/1995 | Gvoich et al. | 473/223 |
| 5,467,993 | A | * | 11/1995 | Higginson | 473/229 |
| D375,774 | S | | 11/1996 | Harrold | |
| 5,595,545 | A | * | 1/1997 | O'Brien | 473/259 |
| 5,816,932 | A | | 10/1998 | Alexander | |
| 5,830,079 | A | | 11/1998 | Hudson | |
| 5,984,798 | A | | 11/1999 | Gilmour | |
| 6,821,213 | B1 | | 11/2004 | Ko | |
| 6,863,619 | B2 | | 3/2005 | Blacklock | |
| 7,074,133 | B1 | | 7/2006 | Jones et al. | |
| 7,494,421 | B2 | | 2/2009 | Elkins | |
| 7,556,570 | B2 | | 7/2009 | Thormer | |
| 7,708,650 | B2 | | 5/2010 | Lloyd | |
| 7,806,780 | B1 | * | 10/2010 | Plunkett | 473/257 |
| 8,105,177 | B2 | * | 1/2012 | Turner | 473/259 |
| 2005/0075186 | A1 | * | 4/2005 | Liao | 473/259 |

(Continued)

FOREIGN PATENT DOCUMENTS

| | | |
|---|---|---|
| AU | 2005203101 | 8/2005 |
| GB | 227725 | 1/1925 |
| WO | WO90/10479 | 9/1990 |

*Primary Examiner* — Raleigh W Chiu
(74) *Attorney, Agent, or Firm* — The Livingston Firm; Edward M. Livingston, Esq.; Bryan L. Loeffler, Esq.

(57) ABSTRACT

A golf swing training device (1) having a substantially circle or oval-shaped ring (2) that stands at an angle to the ground. A guide (5) is slidably attached to the ring. A golf club (8) may be attached to a bracket (34) that is rotatably attached to housing (9) located on the guide. As an individual swings the golf club around the ring, the housing slides to allow for radial displacement of the golf club. In addition, the bracket rotates within the housing to allow for wrist rotation. Motors (37, 38, 39, 40, 12, 16) and gears (15, 17), controlled by one or more microprocessors (22) control the movement of the various components of the golf swing training device, thereby controlling the position of the golf club as well as the position of the user's body as the guide travels around the ring.

20 Claims, 6 Drawing Sheets

(56) References Cited

U.S. PATENT DOCUMENTS

| | | | | |
|---|---|---|---|---|
| 2006/0160635 | A1* | 7/2006 | Thormer | 473/259 |
| 2007/0117642 | A1* | 5/2007 | Fiori | 473/258 |
| 2008/0070712 | A1* | 3/2008 | Jones | 473/257 |
| 2008/0153618 | A1* | 6/2008 | Arther | 473/259 |
| 2010/0124998 | A1* | 5/2010 | Bailey | 473/259 |
| 2010/0216562 | A1* | 8/2010 | Van Rensburg | 473/221 |
| 2011/0269563 | A1* | 11/2011 | Turner | 473/259 |
| 2013/0065704 | A1* | 3/2013 | Napolitano et al. | 473/259 |

* cited by examiner

GOLF SWING TRAINING DEVICE

BACKGROUND OF THE INVENTION

This invention relates to golf training devices, and more particularly to a device that allows a golfer to feel the correct plane, wrist rotation, shaft rotation, shaft extension and leg movement involved in a proper golf swing, thereby improving the golfer's swing through muscle memory.

Conventional golf swing training devices mainly concentrate on teaching the proper swing plane of a golf swing. A swing plane is the plane aligned with the path of intended ball flight. Having a proper swing plane is an important element to a good golf swing, however it is not the only element of a proper golf swing. A good golf swing is a combination of many factors. Accordingly, to learn a proper golf swing, a golfer must also learn the proper wrist and shaft rotation, the proper foot and leg movement and the proper lateral movement or extension of the golf club shaft at the top of a golf swing. Conventional swing plane training devices only focus on teaching the proper swing plane and not proper wrist and shaft rotation, proper foot movement, proper leg movement and so forth.

Therefore, a need exists for a golf swing training device that uses muscle memory to teach a golfer the correct swing plane, the proper wrist and shaft rotation, the proper foot and leg movement and the proper lateral movement or extension of the golf club shaft at the top of a golf swing.

The relevant prior art includes the following references:

| Pat. No. | Inventor | Issue/Publication Date |
|---|---|---|
| (U.S. Patent References) | | |
| 2010/0216562 | Van Rensburg | Aug. 26, 2010 |
| 7,708,650 | Lloyd | May 04, 2010 |
| 7,556,570 | Thormer | Jul. 07, 2009 |
| 7,494,421 | Elkins | Feb. 24, 2009 |
| 2008/0153618 | Arther | Jun. 26, 2008 |
| 7,074,133 | Jones et al. | Jul. 11, 2006 |
| 6,863,619 | Blacklock | Mar. 08, 2005 |
| 6,821,213 | Ko | Nov. 23, 2004 |
| 5,984,798 | Gilmour | Nov. 16, 1999 |
| 5,816,932 | Alexander | Dec. 06, 1998 |
| 5,830,079 | Hudson | Nov. 03, 1998 |
| D375,774 | Harrold | Nov. 19, 1996 |
| 5,423,548 | Bricker | Jun. 13, 1995 |
| 5,330,192 | Amos | Jul. 19, 1994 |
| 5,255,921 | Spence | Dec. 26, 1993 |
| 4,852,881 | Bellagamba et al. | Aug. 01, 1989 |
| 4,583,740 | Ohly | Apr. 22, 1986 |
| 4,280,701 | Beckish | Jul. 28, 1981 |
| 3,711,103 | Seltzer | Jan. 16, 1973 |
| 3,341,208 | Marcella | Sep. 12, 1967 |
| 1,960,787 | MacStocker | May 29, 1934 |
| 1,944,942 | MacDonald | Jan. 30, 1934 |
| (Foreign Patent References) | | |
| AU2005203101 | Blacklock | Aug. 11, 2005 |
| WO90/10479 | Elford | Sep. 20, 1990 |
| GB227,725 | MacNaughton | Jan. 22, 1925 |
| (Non-Patent References) | | |

http://www.trinityinternationalgolf.com/
http://www.intheholegolf.com/store/explanar.html
http://www.wayoutgolfer.com/golf-training-aids-swing-plane/
http://www.shop.com/Groove+Tube+Trainer+Golf+Swing+Plane+Trainer-27391176-p+.xhtml

SUMMARY OF THE INVENTION

The primary object of the present invention is to provide a golf swing training device that controls the placement of an individual's arms, hands, legs and hips throughout an entire golf swing, thereby allowing the individual to feel what a proper golf swing feels like and learn proper technique through muscle memory.

Another object of the present invention is to provide a golf swing training device that can be programmed to emulate various golf swings and speeds.

An additional object of the present invention is to provide a golf swing training device that allows a user to actually hit a golf ball while in the device.

The present invention fulfills the above and other objects by providing a golf swing training device having a substantially circle or oval-shaped ring that stands at an angle to the ground. A guide is slidably attached to the ring and is able to slide freely and/or may be powered by motors that control the speed of the golf club. A golf club is attached to a bracket that is rotatably attached to a housing attached with glide rails to the guide. As an individual swings the golf club around the ring, the housing glides to allow for radial displacement of the golf club. In addition, the bracket is able to rotate within the housing to allow for wrist rotation. Also the golf club rotates in the bracket to open and close the club face. Motors and gears are used to control the rotation of the golf club, the rotation of the bracket, the sliding of the housing and the speed of the guide, thereby controlling the position of the golf club as well as the individual as the guide travels around the ring. The motors and gears may be controlled by at least one microprocessor programmed to activate the motors to move the golf club into a certain position depending on the location of the golf club along the ring. For example, at the top of the golf swing the shaft of the golf club will be rotated so the face of the head is facing forward and as the golf club swings downward, the shaft is rotated so that the face will be facing the golf ball at the moment of impact and then rotated through the back swing. The housing also rotates so at the top of the swing the club will be angled upward. Then, as the golf club travels around the ring the housing will be rotated by a motor, thereby causing the golf club to be perpendicular to the ground at the moment of impact with the golf ball and then rotated into the proper position in the backswing. Sensors, such as accelerometers, gyrometers and so forth, are located around the ring are used to communicate the location of the golf club to the at least one microprocessor, thereby allowing the at least one microprocessor to control the motors and gears so that the golf club is positioned correctly. The at least one microprocessor may be programmed to emulate different golf swings, such as the golf swing of a favorite pro-golfer. The rotation of the housing may be controlled by motors, such as electronic motors, stepper motors, servo motors and so forth or other means, such as hydraulics, magnetic induction, pneumatic devices. In addition, the golf swing training device may be programmed for right handed player or left handed players.

The golf swing training device may further comprise a platform having pedals that automatically move a user's feet in accordance with what point the user is at during his or her swing. For example, as a user swings through the point of contact with a golf ball a rear pedal rotates the user's rear foot into the proper position. In addition, the golf training device may also comprise an automatic ball teeing device that automatically places a golf ball on a tee in front of the ring, thereby allowing an individual to hit multiple golf balls without having to exit the ring.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
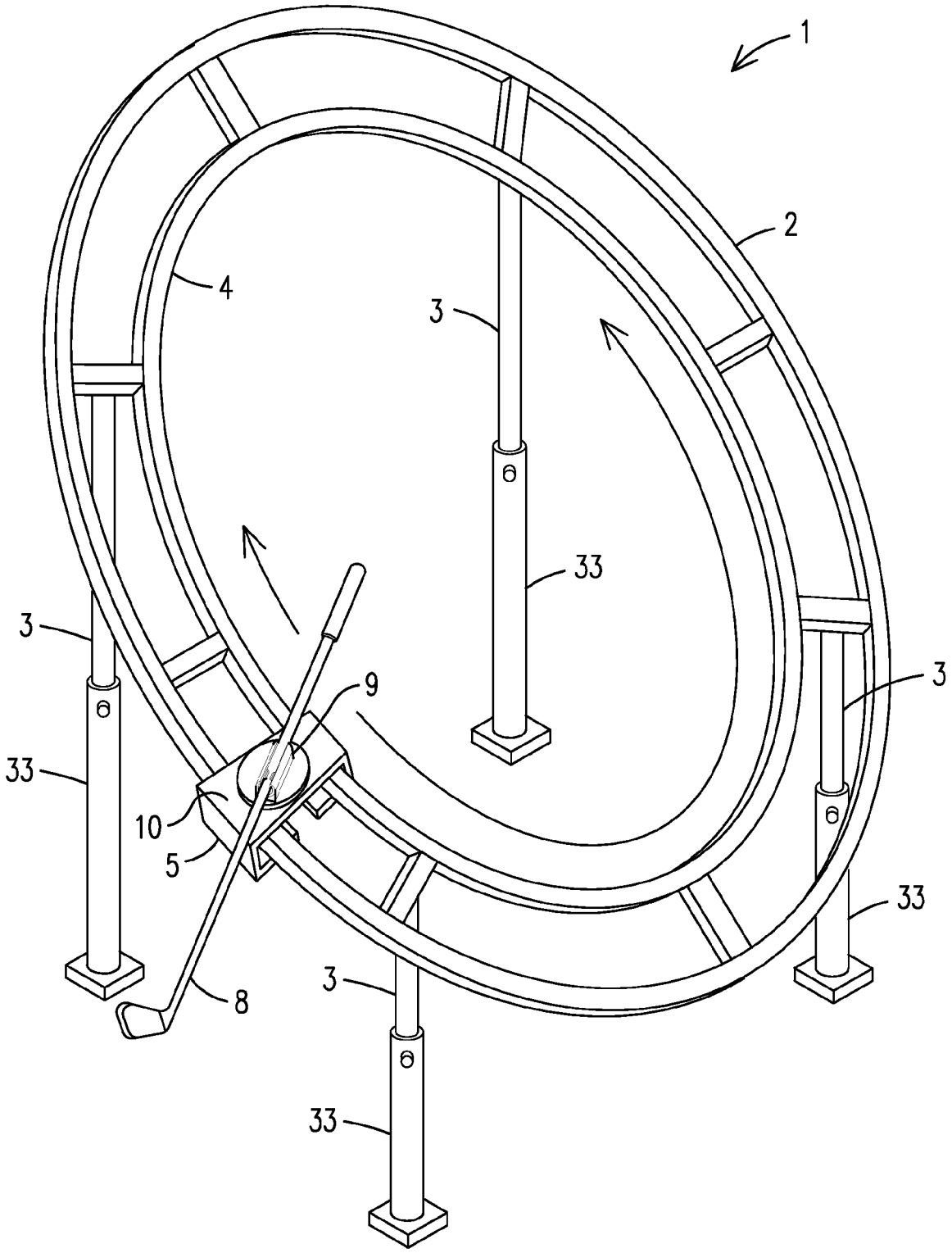
FIG. 1 is a front perspective view of a golf swing training device of the present invention.
Figure 2:
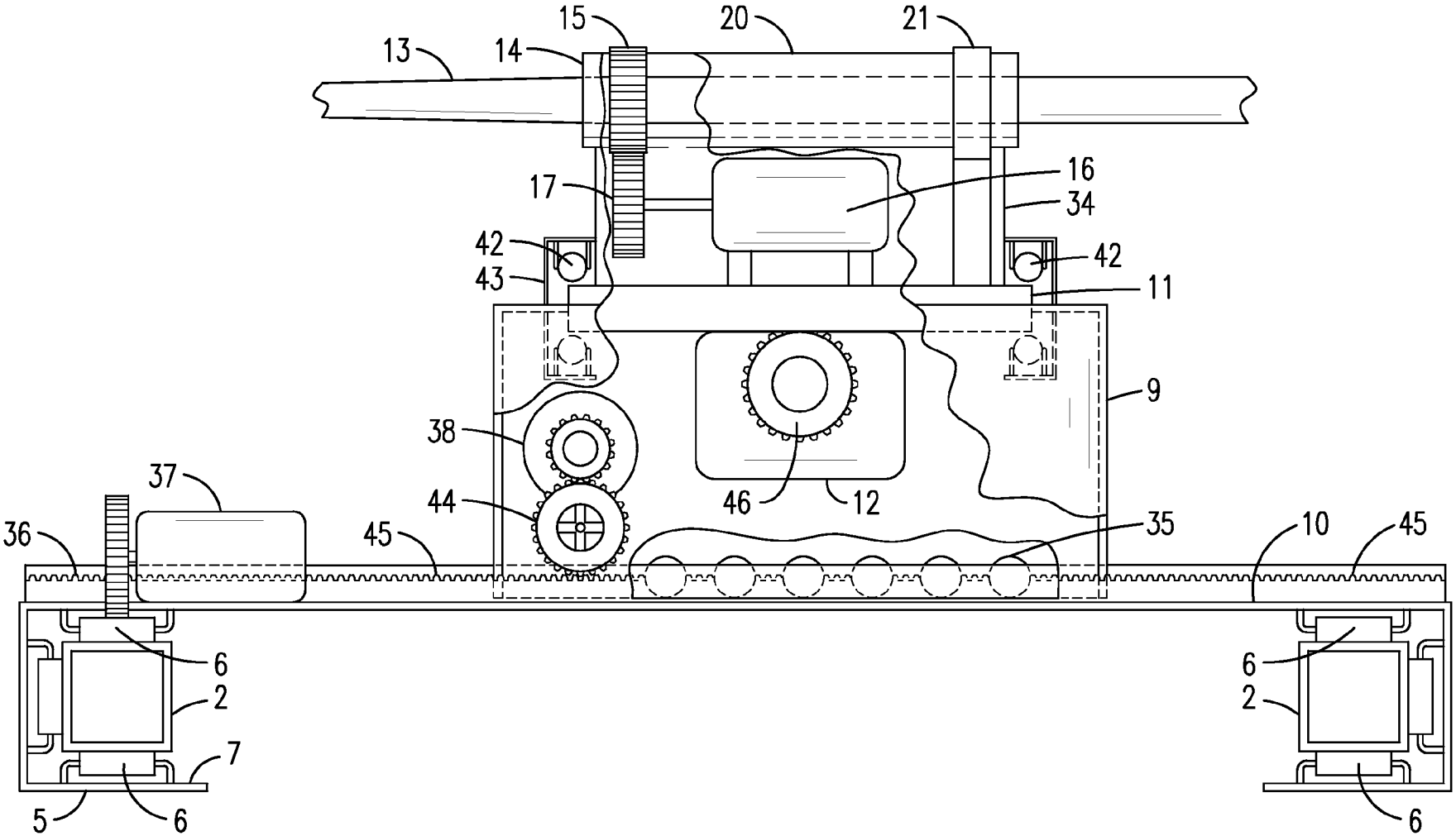
FIG. 2 is a side partial cutaway plan view of a guide and housing of the present invention.
Figure 3:
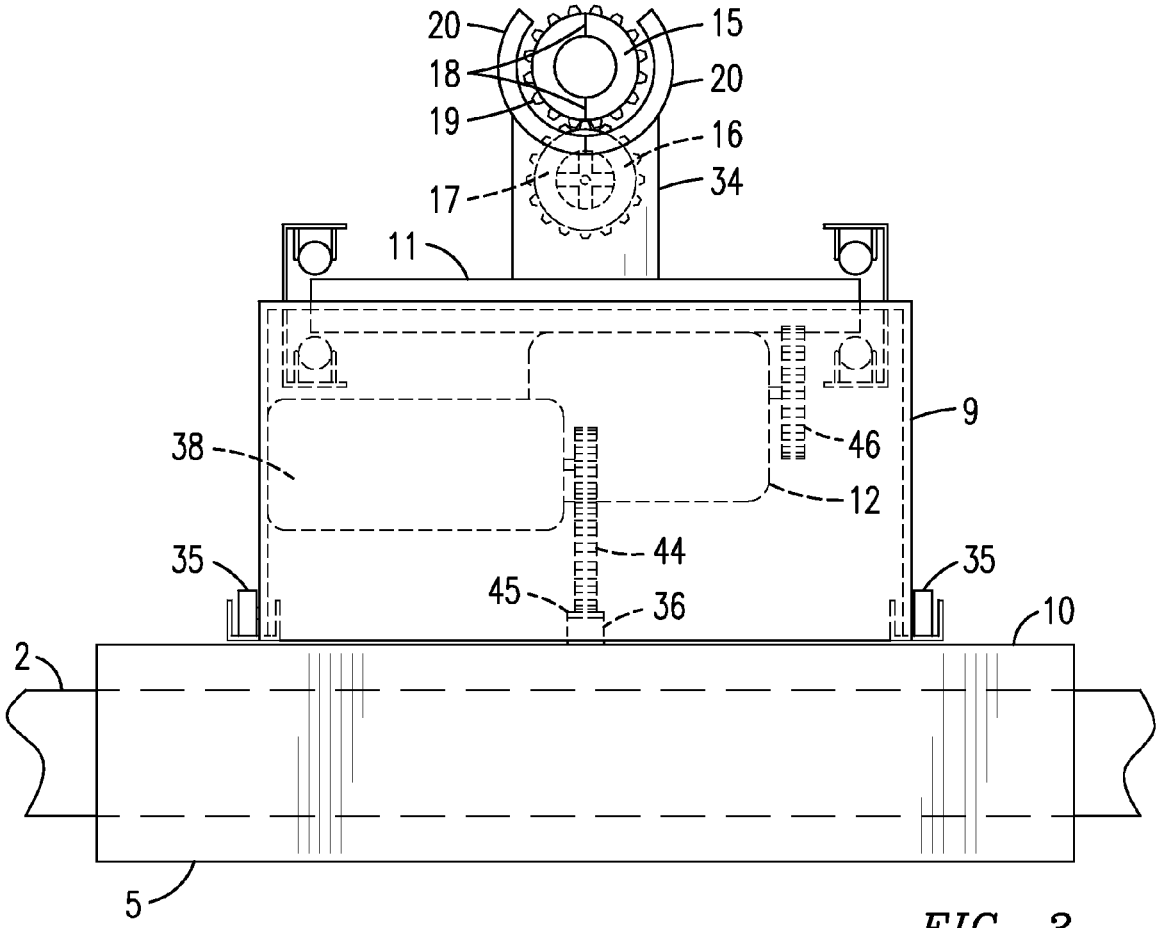
FIG. 3 is a front view of a guide and housing of the present invention.

For purposes of describing the preferred embodiment, the terminology used in reference to the numbered accessories in the drawings is as follows:

1. golf swing training device
2. ring
3. leg
4. inner surface of ring
5. guide
6. movement means
7. inner surface of guide
8. golf club
9. housing
10. upper surface of guide
11. first rotating means
12. third motor
13. shaft
14. second rotating means
15. first gear
16. fourth motor
17. second gear
18. break point
19. gear teeth
20. C-shaped flanges
21. clamping means
22. microprocessor
23. sensing means
24. clamping means
25. foot placement platform
26. ball teeing device
27. right pedal
28. left pedal
29. golf ball
30. power source
31. computer
32. ring lateral movement means
33. height adjustment means
34. bracket
35. glides
36. first gliding means
37. first motor
38. second motor
39. fifth motor
40. sixth motor
41. seventh motor
42. stability bearing
43. bearing housing
44. third gear
45. first flat gear
46. fourth gear
47. fifth gear With reference to FIG. 1, a front perspective view of a golf swing training device 1 of the present invention is illustrated. The golf swing training device 1 comprises a ring 2, which is preferably substantially circle or oval-shaped and may be made in two parts for slidable size adjustment to accommodate various sizes of golfers. The ring 2 is supported by a plurality of legs 3 extending downward from a inner surface 4 of the ring 2. The legs 3 are preferably telescopically extendable to allow for height adjustment. The ring 2 stands at an angle to the ground. A guide 5 is slidably attached to the ring 2 and slides around the ring 2 via a movement means 6, such as rollers, located on an inner surface 7 of the guide 5 (as illustrated in FIG. 2). The movement means 6 may be free wheeling or powered to control the speed of the guide 5 along the ring 2. A golf club 8 is attached to a bracket 34 that is rotatably attached to a housing 9 attached with glides 35 to the upper surface 10 of the guide 5. As an individual swings the golf club 8 around the ring 2, the housing 9 slides on the guide 5 to allow for radial displacement of the golf club 8. The bracket 34 rotates in the housing 9 to allow for wrist rotation. The golf club 8 also rotates within the bracket 34 to allow for shaft rotation (i.e., opening and closing of the club face).

With reference to FIGS. 2, 3 4*a* and 4*b*, a side partial cutaway plan view, a front view, a top view and a side perspective view, respectively, of a guide 5, and housing 9, and bracket 34 of the present invention is illustrated. A movement means 6, such as rollers, located on an inner surface 7 of the guide 5 allow the guide 5 to slide or be powered around the ring 2. A first motor 37 powers one or more of the movement means 6 to control the speed of the guide 5 around the ring 2. The housing 9 is attached with glides 35 to the upper surface 10 of the guide 5, thereby allowing the housing 9 to slide on top of the guide 5. A first gliding means 36 controls the sliding of the housing 9. A second motor 38 controls the rate and extent of the housing 9 sliding along the guide 5 via a third gear 44 that engages a flat gear 45 located on the guide 5. A first rotating means 11 controls the rotation of the bracket 34 via a means, such as stability bearings 42 held within a bearing housing 43. As illustrated here, the first rotating means 11 comprises a third motor 12 located on the inner surface of the housing 9 or other suitable location. The third motor 12 is connected to the housing 9 and controls the rotation of the bracket 34, via a fourth gear 46 in relation to the guide 5 depending on where the guide 5 is located on the ring 2 (as illustrated in FIG. 1). A shaft 13 of a golf club 8 is held within the bracket 34 by a second rotating means 14. As illustrated here, the second rotating means 14 comprises a first gear 15, a fourth motor 16 and a second gear 17. The first gear 15 is preferably a substantially tubular shape having a break point 18 located on an upper and lower portion thereof. Gear teeth 19 are located on an outer surface of the first gear 15 for engaging the second gear 17. C-shaped flanges 20 located on the bracket 34 hold the first gear 15 within the bracket 34. The shaft 13 of the golf club 8 may be held in the first gear 15 by pressure applied on the shaft 13 from the first gear 15 or by a clamping means 21, such as a hose clamp, spring clamp, a Morris taper system and so forth. The fourth motor 16 is connected to the second gear 17 which engages and rotates the first gear 15 using the power of the fourth motor 16. The fourth motor 16 controls the rotation and of the golf club 8 in relation to the ground depending on where the guide 5 is located on the ring 2. The ring 2 is mounted to the legs 3 by a ring lateral movement means 32 which allows the ring 2 to move along the swing plane. A fifth motor 39 controls the lateral movement of the ring 2, via a fifth gear 47, along the swing plane depending on where the guide 5 is located on the ring 2. The movement of the ring 2 along the swing plane allows for the fact a perfect swing is not a circle. The legs 3 are equipped with height adjustment means 33 controlled by a sixth motor 40. The sixth motor 40 controls the height of the legs 3 depending on the height of a user. The first motor 37, the second motor 38, the third motor 12, the fourth motor 16, the fifth motor 39 and the sixth motor 40 are controlled by a microprocessor 22 programmed to activate the first motor 37, the second motor 38, the third motor 12, the fourth motor 16, the fifth motor 39 and the sixth motor 40, thereby moving the golf club 8 into a predetermined position depending on the location of the guide 5 on the ring 2. A sensing means 23, such as accelerometers, gyrometers and/or sensors located around the ring are used to communicate the location of the guide 5 to the microprocessor 22.

Figure 5A:
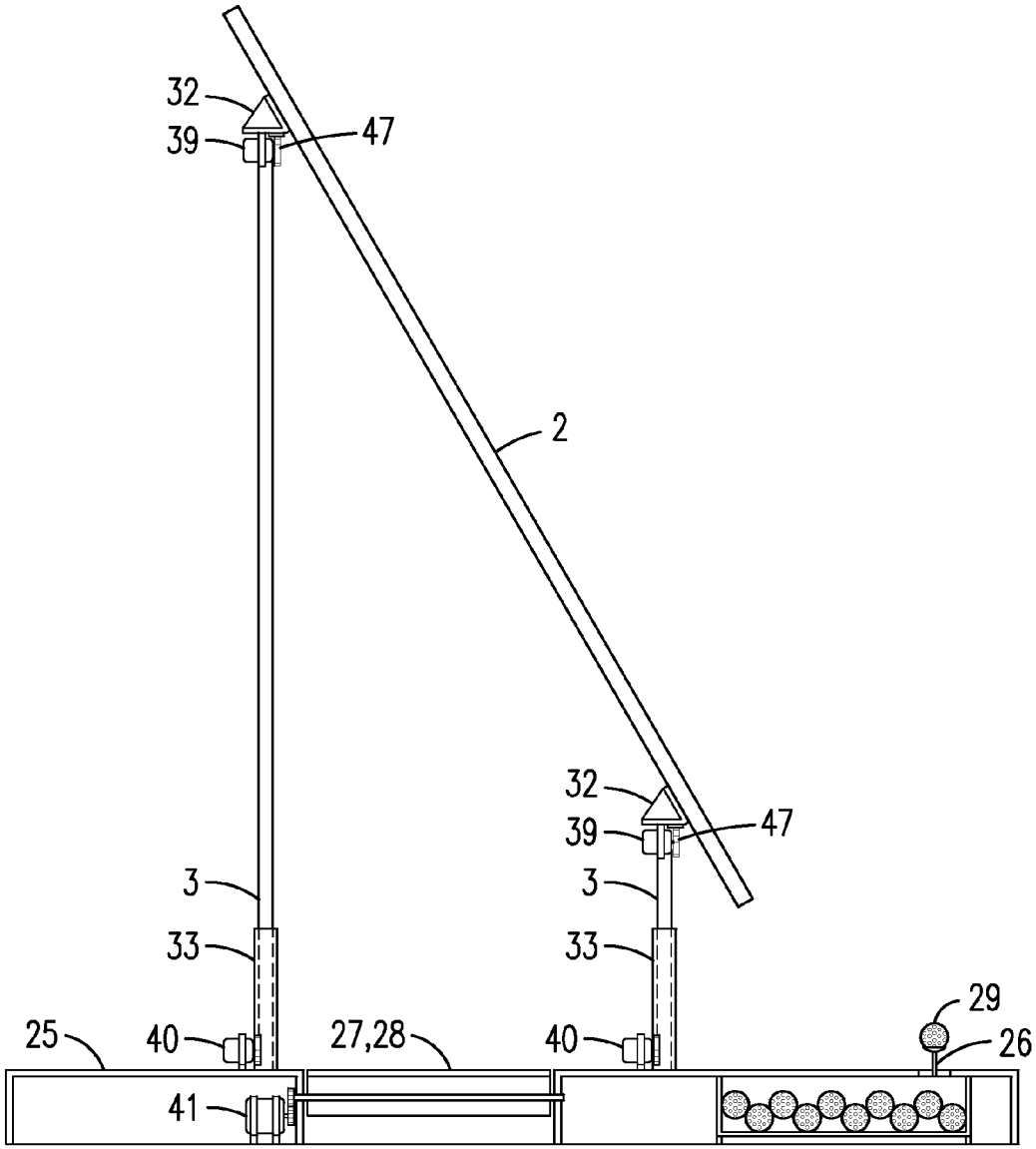
FIG. 5*a* is a side view of a golf swing training device having a foot placement platform and automatic ball teeing device.
Figure 5B:
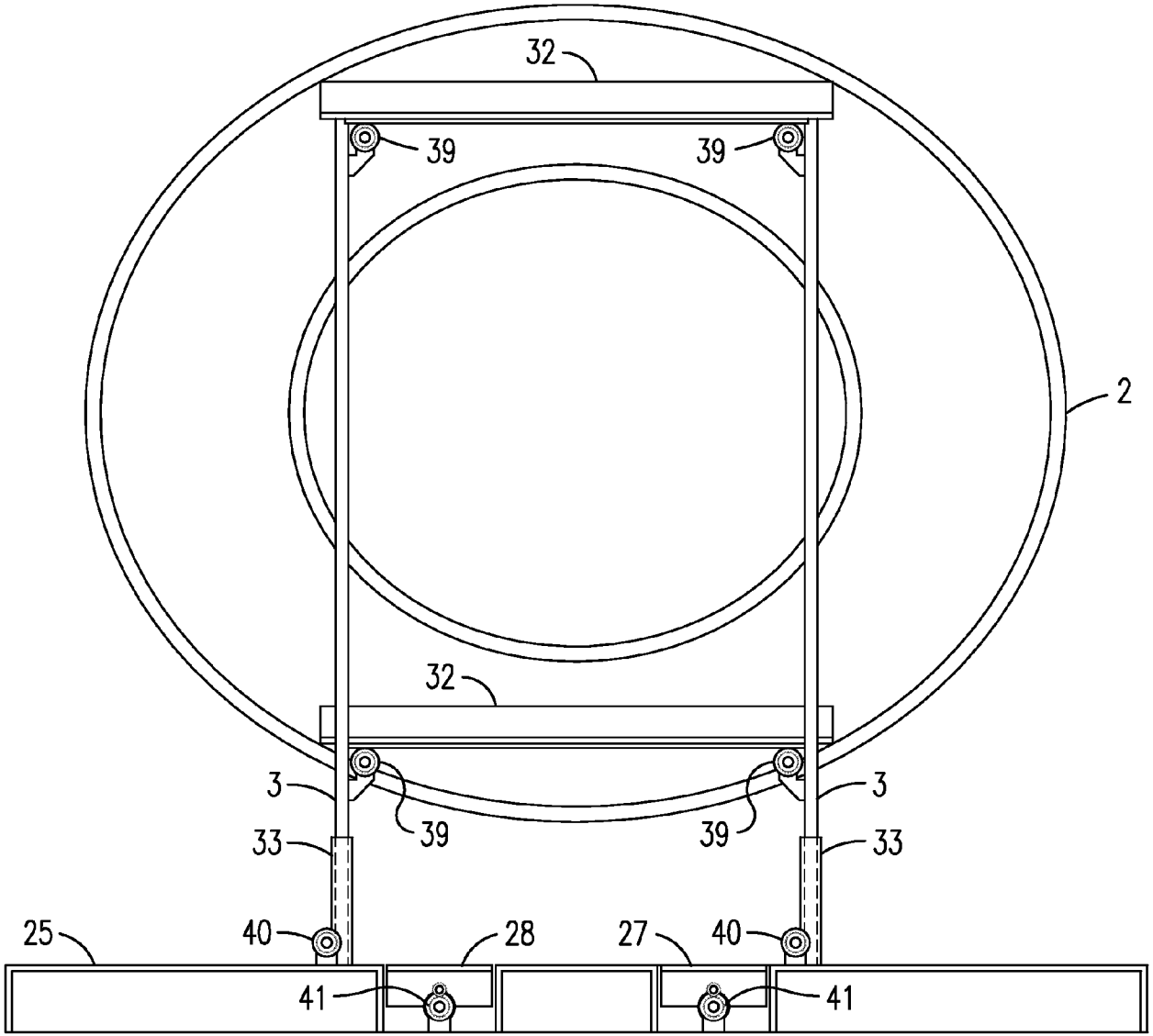
FIG. 5*b* is a rear view of a golf swing training device having a foot placement platform and automatic ball teeing device.

With reference to FIGS. 5*a* and 5*b*, a side view and a rear view, respectively, of a golf swing training device 1 having a foot placement platform 25 and automatic ball teeing device 26 is illustrated. The golf swing training device 1 is located above a foot placement platform 25 having a right pedal 27 and a left pedal 28. The pedals 27, 28 are controlled by a seventh motor 41, which automatically move a user's feet in accordance with what point the user is at during his or her swing. For example, as a user swings through the point of contact with a golf ball the right pedal 27 rotates the user's rear foot into the proper position. The pedals are controlled by a microprocessor 22 (as shown in FIG. 2) programmed to activate one or more actuating means, such as motors, hydraulics and so forth, that move the pedals 27, 28 into a predetermined position depending on the location of the guide 5 on the ring 2. The automatic ball teeing device 26 automatically places a golf ball 29 on a tee located in front of the golf swing training device 1, thereby allowing an individual to hit multiple golf balls without having to exit the ring 2.

Figure 6:
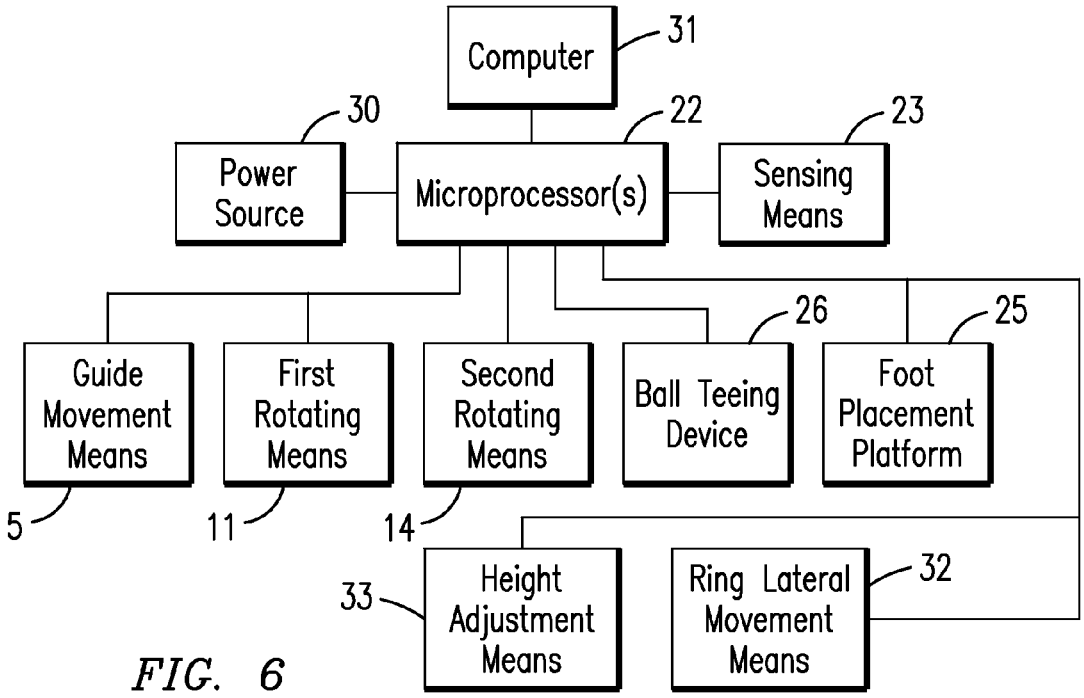
FIG. 6 is a block diagram of a microprocessor and components controlled by the microprocessor.
Figure 4A:
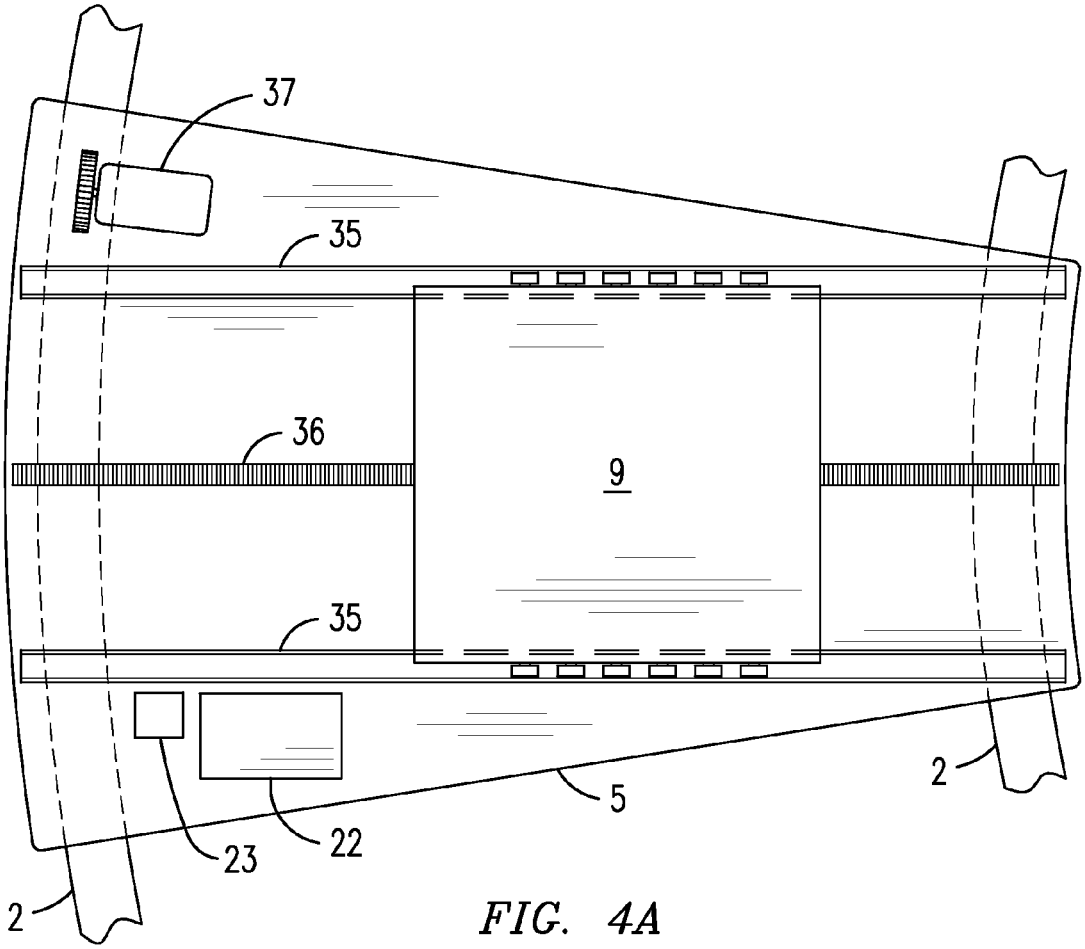
FIG. 4*a* is a top view of a guide and housing of the present invention.
Figure 4B:
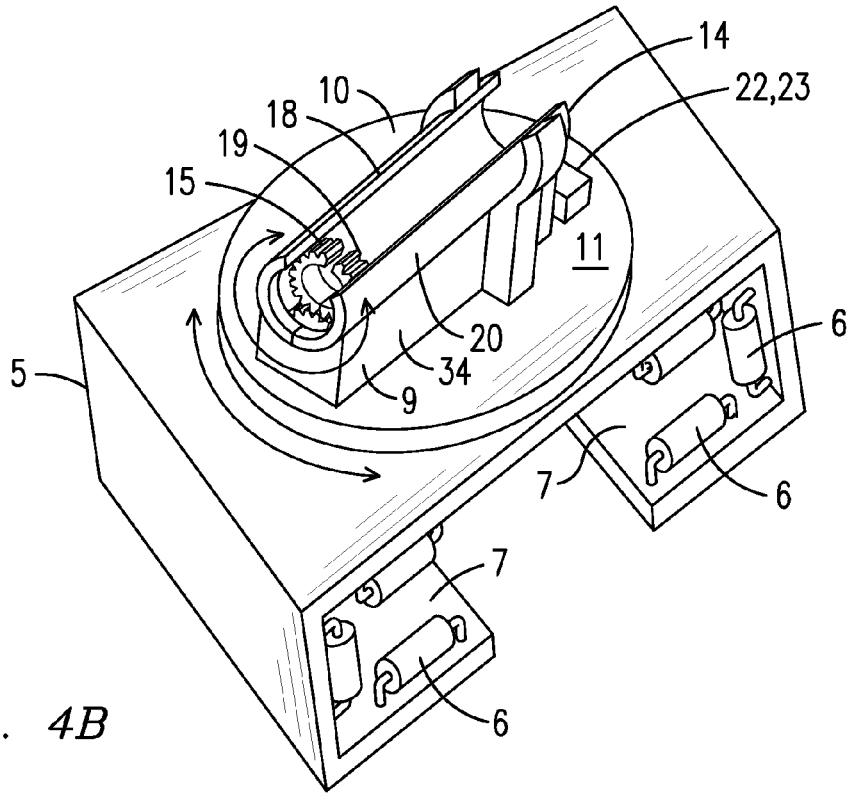
FIG. 4*b* is a top perspective view of a guide and housing of the present invention.

With reference to FIG. 6, a block diagram of a microprocessor 22 and components controlled by the microprocessor 22 is illustrated. The microprocessor 22 is powered by a power source 30 that also powers other components of the golf swing training device 1. The microprocessor 22 may be programmed by a computer 31 to activate various components of the golf swing training device 1 depending on the location of the guide on the ring. A sensing means 23, such as accelerometers, gyrometers, sensors located around the ring and so forth, are used to determine the location of the guide on the ring and communicate the location of the guide to the microprocessor 22. The microprocessor 22 controls the guide 5 movement means 6. The microprocessor 22 also controls a first gliding means 36 moving the housing 9 on the guide 5 and a first rotating means 11 which rotates a bracket 34 located on the housing 9. In addition, the microprocessor 22 controls a second rotating means 14 which rotates a shaft of a golf club. The microprocessor 22 also controls a ring lateral movement means 32, which moves the ring 2 forward and backward along the swing plane. The microprocessor 22 also controls a height adjustment means 33, which raises and lowers the legs 3. The microprocessor 22 also controls a foot placement platform 25 with right and left pedals 27, 28. Finally, the microprocessor 22 controls a ball teeing device 26 that automatically places a golf ball on a tee is located in front of the golf swing training device.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A golf swing training device comprising:
- a ring supported by a plurality of legs extending downward from the ring;
- a guide slidably attached to the ring;
- a housing slidably attached to the guide;
- a bracket rotatably attached to the housing
- a first rotating means for controlling the rotation of the bracket on the housing;
- a first gliding means for controlling the slide of the housing on the guide;
- a ring lateral movement means for controlling the location of the ring along a swing plane; and
- a second rotating means for controlling the rotation of a shaft of a golf club that is held within the bracket.

2. The golf swing training device of claim 1 wherein:
- said guide is powered around the ring by a motor.

3. The golf swing training device of claim 1 wherein:
- said ring lateral movement means further comprises a motor for controlling the location of the ring along the swing plane.

4. The golf swing training device of claim 1 further comprising:
- a height adjustment means for controlling the height of the plurality of legs.

5. The golf swing training device of claim 4 further comprising:
- a motor for controlling the height adjustment means and the height of the plurality of legs.

6. The golf swing training device of claim 4 further comprising:
- at least one microprocessor for controlling the height adjustment means.

7. The golf swing training device of claim 6 further comprising:
- at least one sensing means for sensing a location of the guide on the ring and communicating the location to the at least one microprocessor.

8. The golf swing training device of claim 1 wherein:
- said first rotating means further comprises a motor for rotating the bracket on the housing.

9. The golf swing training device of claim 1 wherein:
- said second rotating means further comprises a motor and at least one gear for rotating the shaft of the golf club.

10. The golf swing training device of claim 1 wherein:
- said first gliding means further comprises a second motor for controlling the location of the housing on the guide.

11. The golf swing training device of claim 1 further comprising:
- at least one microprocessor for controlling the first rotating means, the second rotating means, the first gliding means and the ring lateral movement means.

12. The golf swing training device of claim 11 further comprising:

at least one sensing means for sensing a location of the guide on the ring and communicating the location to the at least one microprocessor.

13. The golf swing training device of claim 1 wherein:

said bracket further comprises at least two C-shaped flanges for holding the second rotating means within the bracket.

14. The golf swing training device of claim 1 further comprising:

a clamping means for securing the shaft of the golf club within the bracket.

15. The golf swing training device of claim 1 further comprising:

a foot placement platform located under the ring for controlling the placement of an individual's feet while swinging the golf club within the ring.

16. The golf swing training device of claim 15 further comprising:

a motor for controlling the foot placement platform.

17. The golf swing training device of claim 16 further comprising:

at least one microprocessor for controlling the motor.

18. The golf swing training device of claim 1 further comprising:

a ball teeing device located proximate to the ring for automatically placing a golf ball on a tee.

19. The golf swing training device of claim 1 wherein:

said plurality of legs are telescopically extendable.

20. The golf swing training device of claim 1 wherein:

said ring comprises two parts slidably attached to each other.

* * * * *

UNITED STATES PATENT AND TRADEMARK OFFICE

CERTIFICATE OF CORRECTION

PATENT NO. : 8,715,098 B2
APPLICATION NO. : 13/232288
DATED : May 6, 2014
INVENTOR(S) : Napolitano et al.

It is certified that error appears in the above-identified patent and that said Letters Patent is hereby corrected as shown below:

Title Page, Item (76) Inventors, should read as follows:

--(76) Inventors: David Napolitano, Punta Gorda, FL (US); Don Drumm, Port Charlotte, FL (US)--.

Signed and Sealed this
Third Day of March, 2015

Michelle K. Lee

Michelle K. Lee
*Deputy Director of the United States Patent and Trademark Office*